United States Patent [19]

Barker

[11] Patent Number: 4,517,776

[45] Date of Patent: May 21, 1985

[54] ROOF INSULATION RETENTION

[75] Inventor: Michael Barker, Zurich, Switzerland

[73] Assignee: The Dow Chemical Company, Midland, Mich.

[21] Appl. No.: 473,903

[22] Filed: Mar. 10, 1983

[51] Int. Cl.[3] ..... E04B 7/02

[52] U.S. Cl. ..... 52/90; 52/407; 52/409; 52/712

[58] Field of Search ..... 52/90, 489, 407, 712, 52/409, 410, 714, 715

[56] References Cited

U.S. PATENT DOCUMENTS

| | | | |
|---|---|---|---|
| 4,075,807 | 2/1978 | Alderman | 52/90 |
| 4,255,910 | 3/1981 | Wendt | 52/489 |
| 4,455,805 | 6/1984 | Rionda et al. | 52/712 |

FOREIGN PATENT DOCUMENTS

| | | | |
|---|---|---|---|
| 2056108 | 5/1972 | Fed. Rep. of Germany | 52/489 |

*Primary Examiner*—Donald G. Kelly
*Assistant Examiner*—Naoko N. Slack
*Attorney, Agent, or Firm*—R. B. Ingraham

[57] ABSTRACT

A counter batten-rafter connecting bracket comprises a rafter engaging member to be secured to a roof rafter, a generally planar connecting member normal to the rafter engaging member, a counter batten engaging member extending parallel to the rafter engaging member and affixed to the connecting member. The rafter engaging member and counter batten engaging member each has at least one flange disposed in a plane normal to the planes of the rafter engaging member 1, counter batten engaging member and connecting member.

16 Claims, 7 Drawing Figures

ROOF INSULATION RETENTION

Figure 1:
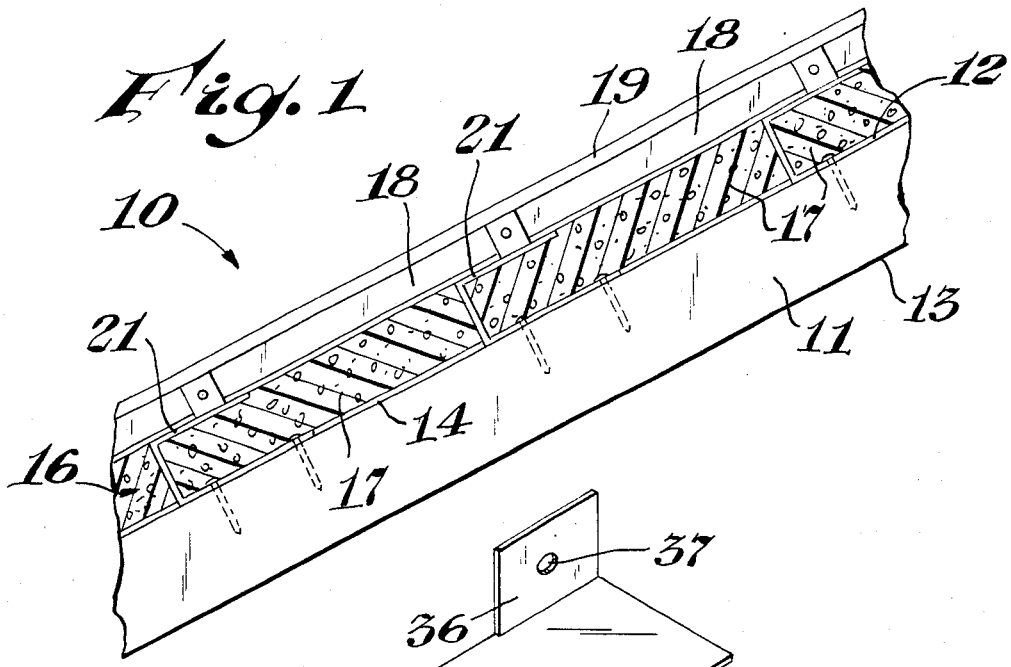

In the construction of roofs on buildings, oftentimes it is desirable to incorporate a layer of thermal insulation in the roof structure. In one method of constructing a thermally insulated pitched roof, a thermally insulating layer generally of rigid thermal insulation such as a plastic foam is installed over the rafters and maintained in place by a counter batten, the counter batten being attached to the rafters. Oftentimes in the construction of such a roof, a layer of roofing felt is applied to the rafters, sheets or boards of thermally insulating materials are then positioned over the roofing felt layer or alternatively directly on the rafters, and a counter batten placed over the layer of rigid thermally insulating material. The counter battens are then nailed to the rafters by means of a nail through the counter batten, through the insulating layer and through the layer of the roofing felt, if employed, and into the rafter. Such a mode of construction presents some practical difficulties. Relatively long nails are required to fasten the counter batten to the roof rafters. The rafters are hidden from view by means of the insulating layer, and in some instances also by the roofing felt layer. From a practical standpoint, this type of construction provides some significant difficulty in that a long nail is being passed through the batten, through the insulating layer, and hopefully the nail encounters the rafter to provide the desired fastening. Oftentimes in such a roof construction the nail completely fails to engage the rafter or passes through the edge of the rafter and consequently has less than the desired holding power. In such roof installations oftentimes the nailing of the counter batten to the rafter involves considerable hope, guessing, and faith. Alternatively, it involves considerable time and effort in careful measuring of the spacing of the rafters, and measuring to determine the location of the counter battens and nailing members.

It is an object of this invention to provide an improved means of roof construction employing a layer of thermal insulation disposed over the roof rafters.

It is also an object of the present invention to provide an improved means of connecting counter battens to roof rafters over a layer of thermal insulation.

It is also an object of the present invention to provide an improved means of connecting a counter batten to a roof rafter wherein the counter batten and roof rafter are separated by at least a layer of thermal insulation.

These benefits and other advantages in accordance with the present invention are achieved in a counter batten-rafter connecting bracket, the bracket comprising a generally sheet-like body, the sheet-like body having a first planar arm or rafter engaging member to be nailed or otherwise secured to a roof rafter, a generally planar connecting member, having a generally planar configuration extending generally normally to the rafter engaging member, a counter batten engaging or fastening member affixed to the connecting member, the counter batten engaging member extending generally parallel to the rafter engaging member; the counter batten fastening member affixed to the connecting member, the counter batten fastening member extending generally normal to a plane containing the planar arm member engaging member, the counter batten fastening member being generally remote from the rafter engaging member, the counter batten fastening member lying in a plane generally normal to the connecting member.

Also contemplated within the scope of the present invention is a roof structure comprising a plurality of generally elongate rafter, the rafters being arranged in a generally planar manner, the plane of the rafters being such that a roof pitch is thereby obtained, a layer of generally rigid thermal insulation being disposed above the rafters, a counter batten being disposed over the layer of rigid insulation and being affixed to said rafters, the improvement which comprises affixing the counter batten to the rafters, employing a counter batten to rafter connecting bracket as hereinbefore described; and a water impermeable layer disposed over said counter battens.

Other features and advantages of the present invention will become more apparent from the following specification taken in connection with the drawing wherein FIG. 1 is a schematic representation of a sectional view of a roof in accordance with the present invention;

FIGS. 2–7 depict views of various embodiments of counter batten-rafter connecting brackets in accordance with the present invention.

In FIG. 1 there is schematically depicted a sectional view of a roof in accordance with the present invention generally designated by the reference numeral 10. The roof 10 comprises in cooperative combination a plurality of rafters 11. Depicted in FIG. 1, the rafters 11 slope downwardly toward the left to provide a portion of a pitched roof. The rafters 11 have an upper side 12 and a lower side 13. A waterproof membrane 14 is affixed to the upper surface 12 of the rafters 11. The water impermeable membrane may be roofing felt or a like material which provides desired water impermeability. A thermally insulating layer 16 is disposed above the membrane 14. The layer 16 comprises a plurality of generally rigid insulating boards 17. Disposed immediately above the insulating layer 16 are a plurality of counter battens 18 extending in generally parallel relationship to the rafters 11 and the battens 18 are disposed immediately above the corresponding rafters 11. A water impervious and weather resistant layer 19 is disposed above the counter battens 18. A plurality of brackets 21 is disposed between boards 17 affixed to the rafters 11. The brackets 21 extend between boards 17 and are affixed to the counter battens 18 to maintain the counter battens 18 and rafters 11 in generally fixed spaced relationship while maintaining the insulating boards 17 in fixed relationship relative to the rafters 11.

Figure 2:
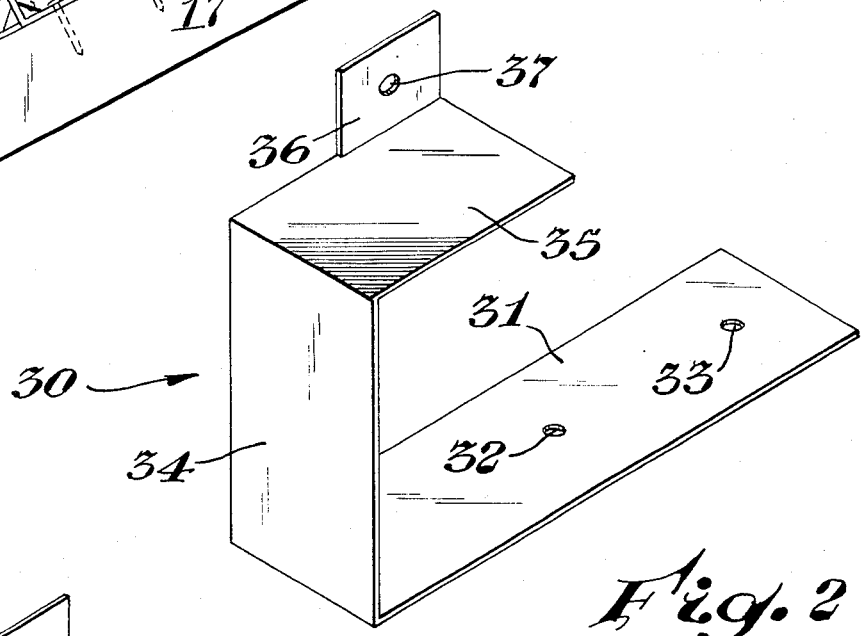

In FIG. 2 there is depicted a schematic isometric representation of a counter batten-rafter engaging bracket in accordance with the present invention generally designated by the reference numeral 30. The bracket 30 is constructed of generally planar material and comprises a first or rafter engaging member 31. The rafter engaging member 31 is of generally planar configuration and defines first and second nail or fastener receiving openings 32 and 33, respectively. Openings 32 and 33 are generally centrally diposed relative to the longitudinal axis of the rafter engaging member 31. A connecting member 34 of generally planar configuration is affixed to an end of the rafter engaging member and extends generally normal to the plane of the rafter engaging member. A counter batten engaging member also of generally planar configuration is designated by the reference numeral 35. The counter batten engaging member is affixed to the connecting member 34 and extends generally normal thereto and parallel to the rafter engaging member 31. The counter batten fastening member 36 is affixed to the counter batten engaging member 35. A counter batten fastening member 36 defines an opening 37 to receive a nail or like fastening means. Counter batten fastening member 36 extends generally normally to the plane of counter batten engaging member 35 and is in a plane generally normal to a plane containing the connecting member 34. In use the bracket 30 is fastened to a rafter such as rafter 11 of the FIG. 1 by means of appropriate fasteners passing through the openings 32 and 33. A rigid insulating board is abutted against the connecting member 34. A counter batten placed over the counter batten engaging means and a suitable fastener passed through the opening 37 of the counter batten fastening member 36 to affix the batten to the bracket 30. The bracket such as the bracket 30 is then applied adjacent and opposing the edge of the insulating board which abuts the connecting member 34 and the process repeated until the entire roof has been installed.

Figure 3:
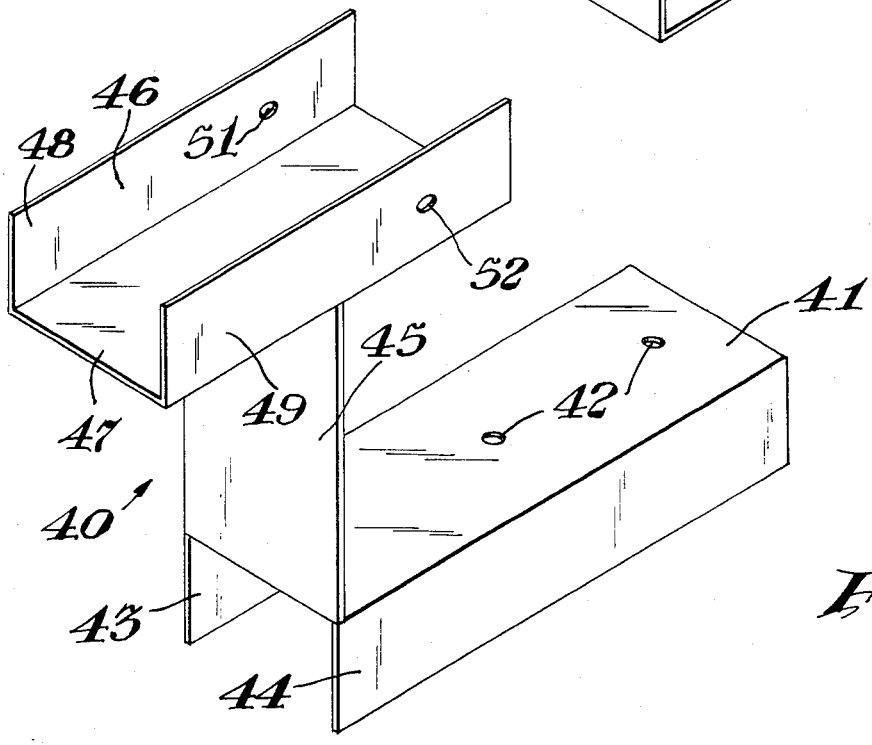

In FIG. 3 there is schematically depicted an isometric view of a counter batten rafter connecting bracket in accordance with the present invention generally designated by the reference numeral 40. The bracket 40 comprises in cooperation a rafter engaging member 41. The rafter engaging member 41 is of generally channel shaped configuration and defines in the web of the channel fastener receiving openings 42 which are generally coaxially disposed relative to the longitudinal axis of the rafter engaging member 41 of said channel shaped configuration. The channel shaped rafter engaging member 41 has flanges 43 and 44 which are spaced a sufficient distance apart to snugly receive a rafter therein. A connecting member 45 is affixed to one end of the rafter engaging member 41 and extends in a plane generally normal thereto in a direction opposite that of the dependent flanges 43 and 44. A counter batten receiving member 46 is affixed to the connecting member 45 remote from the rafter engaging member 41. Counter batten engaging member 46 is of a generally channel shaped configuration. Counter batten engaging member 46 has a web 47 and upwardly projecting flanges 48 and 49. The web 47 of the counter batten engaging member 46 is affixed to the connecting member 45, remote from the rafter engaging member 41. Flanges 48 and 49 are generally parallel to the flanges 43 and 44 respectively and extend upward, whereas the flanges 43 and 44 extend in a downward direction. The flanges 48 and 49 define fastener receiving openings 51 and 52 respectively. Embodiment 40 of the present invention as depicted in FIG. 3 is for roof insulations where a roof membrane, such as the membrane 14 of FIG. 1 is not employed. The bracket 40 of FIG. 3 provides positive alignment of the bracket with a rafter such as the rafter 11 of FIG. 1 and with a counter batten. The connecting member 45 of bracket 40 of FIG. 3 engages the adjacent edges of insulating boards such as the boards 17 of FIG. 1.

Figure 4:
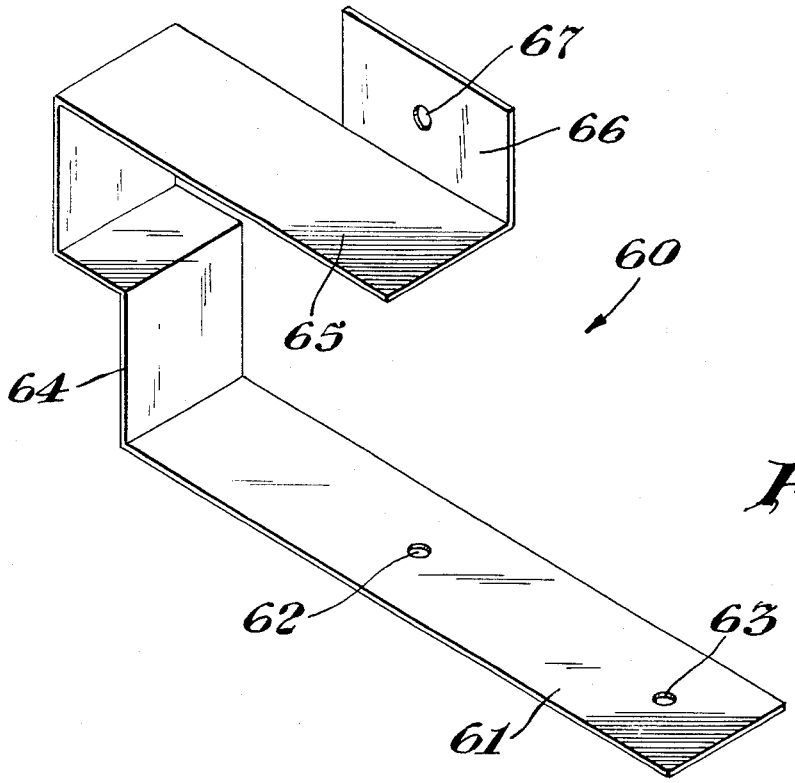

In FIG. 4 there is schematically depicted an alternate embodiment of the invention generally designated by the reference numeral 60. The bracket 60 has a rafter engaging member 61 of generally planar configuration defining holes or openings 62 and 63 which are generally equivalent to openings 32 and 33 and to openings 42 of FIGS. 2 and 3 respectively. The rafter engaging member 61 is of a generally elongate rectangular configuration and has affixed at one end thereof a generally planar Z-shaped bracket connecting member 64, which extends from the rafter engaging member 61. Connecting member 64 has affixed thereto a counter batten engaging member 65. Counter batten engaging member 65 is disposed generally normal to the connecting member 64 and parallel to the rafter engaging member 61. Counter batten fastening member 66 is affixed to the counter batten engaging member 65 in the configuration of a partial flange, the counter batten fastening member 66 is disposed in a plane generally normal to the plane of the counter batten engaging member 65, and in a plane generally normal to the connecting member 64. A fastener receiving opening 67 is generally centrally disposed within the counter batten fastening member 66. The bracket 60 of FIG. 4 is employed in a manner generally similar to the brackets of FIGS. 2 and 3, but is particularly suited and adapated for use with insulating boards having a shiplap joint therebetween.

Figure 5:
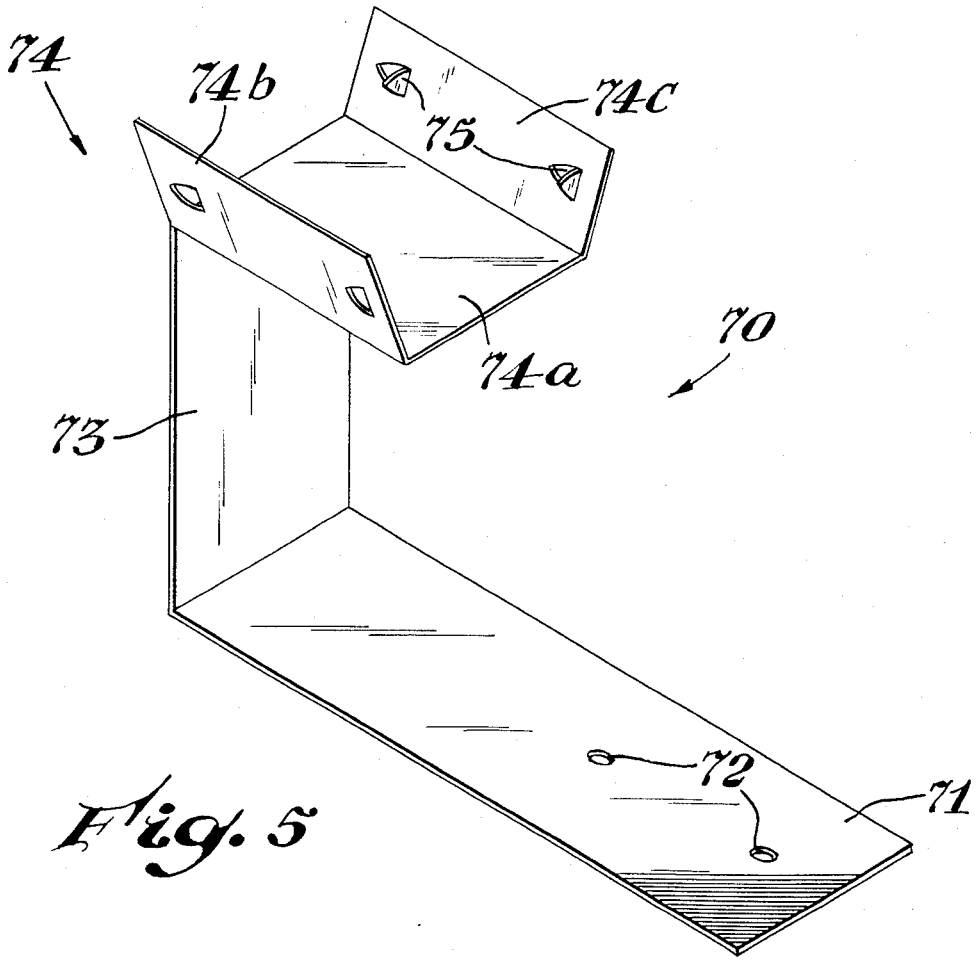

In FIG. 5 there is schematically depicted an alternate embodiment of the invention generally designated by the reference numeral 70. The bracket 70 is constructed from a sheet-like material and comprises a first or rafter engaging member 71 of generally planar elongate rectangular configuration. The member 71 defines at least two fastener receiving openings designated by the reference numeral 72. The openings 72 are adapted to pass fasteners which engage an adjacent rafter and maintain the bracket 70 in fixed relationship thereto. At one end of the rafter engaging member 71 is disposed a connecting member 73 of generally planar rectangular configuration. Connecting member 73 extends in a plane generally normal to the plane of the rafter engaging member 71. A counter batten fastening or engaging means 74 is affixed to the connecting member 73 from the rafter engaging member 74. The counter batten engaging member 74 has a generally channel-like configuration and a web **74*a* having generally upwardly extending flanges 74*b*, and 74*c*. Web 74*a* of the channel-like member 74 is generally parallel to the rafter engaging member 71. The flanges 74*b* and 74*c* each have been deformed to provide a pair of inwardly projecting tooth-like members such as the members 75 of flange 74*c*. The tooth-like members of 74*b* are of nearly identical configuration to the tooth-like members 75 of flange 74*c*. Flanges 74*b* and 74*c* project upward and away from the rafter engaging member 71. The bracket of FIG. 5 is employed in essentially the same manner as the bracket of FIG. 2 with the exception that the flange members 74 and 74*b* having tooth-like projections such as the projections 75 on installation are deformed to cause penetration of the tooth-like members such as 75** into the counter batten to hold it firmly in place.

Figure 6:
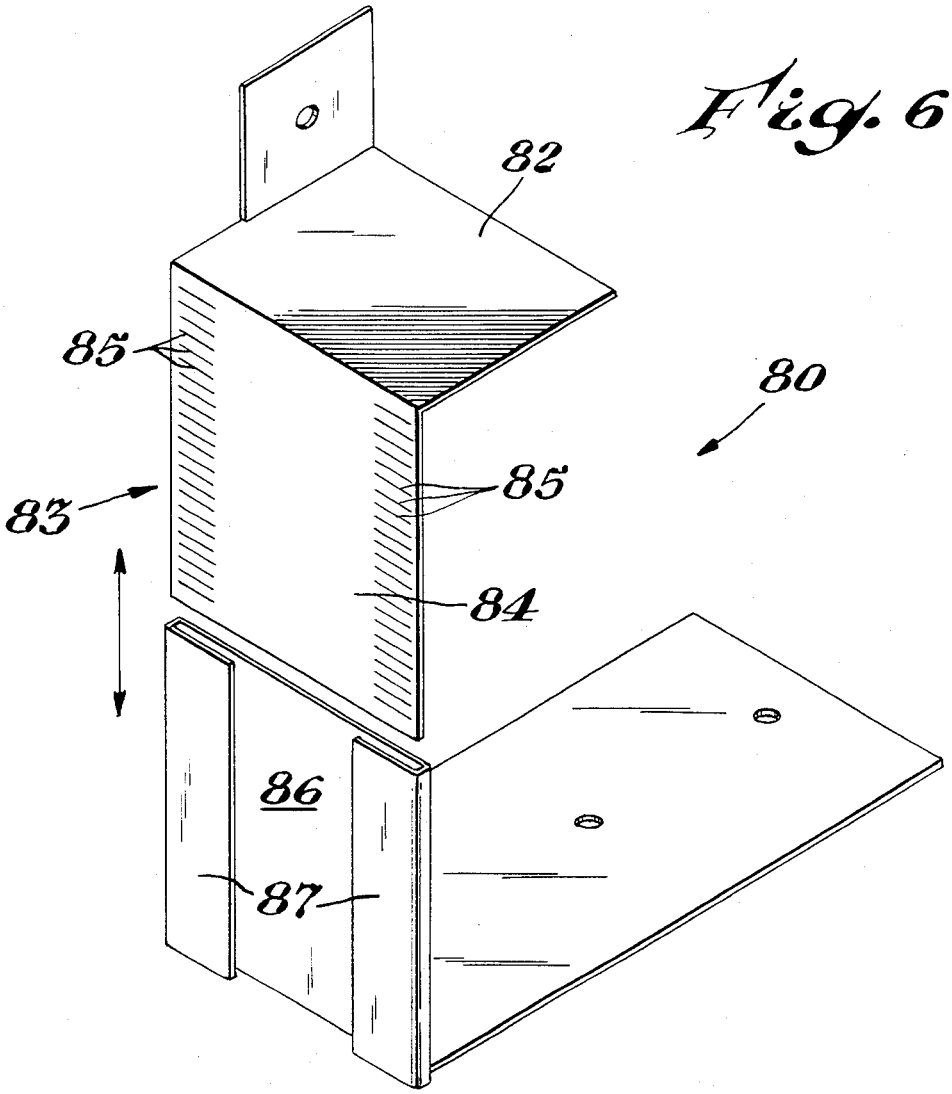

In FIG. 6 there is schematically depicted a bracket in accordance with the present invention generally designated by the reference numeral 80. The bracket 80 comprises a first rafter engaging member 81 and a counter batten fastening member 82 generally equivalent to the rafter engaging member of FIG. 2 and the counter batten engaging and fastening members of FIG. 2. The bracket 80 has a connecting member generally designated by the reference numeral 83. The connecting member 83 extends from one end of the rafter engaging means 81 to one end of the counter batten engaging member 82. The connecting member 83 comprises a first generally rectangular member 84 of sheet-like configuration defining a plurality of serrations 85. The serrations 85 being disposed along opposite edges of the member 84. The serrations 85 being generally parallel to the major planes of members 81 and 82. The serrations 85 are disposed generally normal the adjacent edges of the member 84 of connecting member 83 and provide a means for varying the length of member 83. Connecting member 83 has a second member 86. The member 86 has disposed along the edges thereof extending generally normally from the rafter engaging member 81 a pair of generally identical opposed channels 87 being adapted to receive the member 84 and permit selective positioning of the member 84 within the channels 87 thereby providing a connecting member 83 of selectively variable length. Embodiment 83 of the present invention is particularly desirable wherein rigid insulating boards of either non-uniform of non-standard thicknesses are to be installed on a roof.

Figure 7:
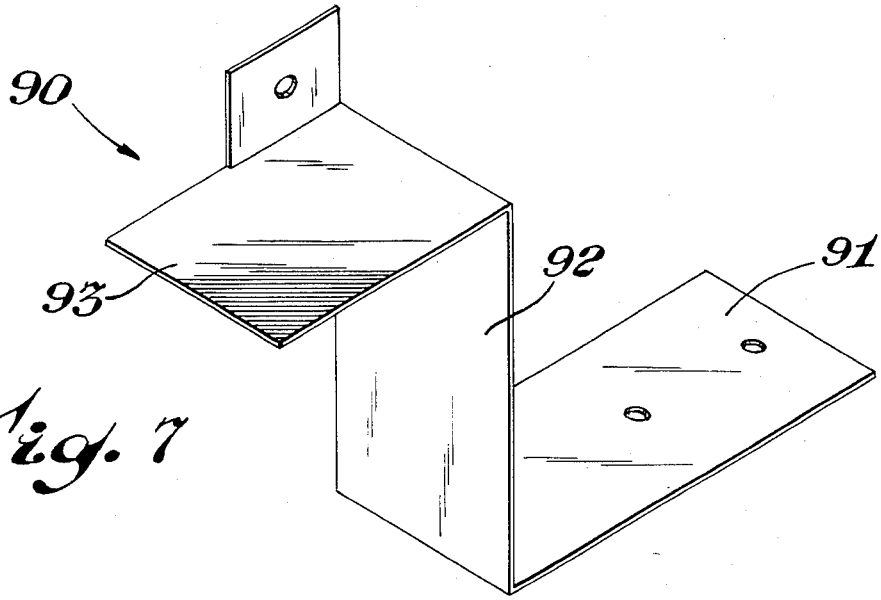

In FIG. 7 there is depicted an alternative embodiment of the invention designated by the reference numeral 90. The bracket 90 comprises a first rafter engaging means 91 generally equivalent to the rafter engaging means of FIG. 2. A connecting means 92 is disposed at one end of the rafter engaging means 91 extends upwardly in a plane generally normal to the rafter engaging means 91. The connecting means 92 is also disposed in a plane which is generally normal to the longitudinal axis of the rafter engaging means 91. The connecting means 92 has affixed thereto a counter batten engaging member 93 fixed to an end of the connecting member 92 remote from the rafter engaging member 91. The member 93 lies in a plane generally parallel to the plane of the rafter engaging member 91. The members 91, 92 and 93 form a generally Z-shaped configuration and immediately adjacent members are disposed normally to each other. The bracket 90 of FIG. 7 provides an advantage in that access to the fastener openings formed in the rafter engaging members 91 is more easily obtained in the configurations where members equivalent to the members 91, 92 and 93 form a generally U-shaped configuration.

Brackets in accordance with the present invention are readily fabricated from a wide variety of materials, from the point of view of economy, galvanized sheet steel being the preferred choice. However, other materials such as brass, copper, aluminum and the like may be beneficially employed. The brackets may also be fabricated from a variety of synthetic resinous materials, both thermoplastic and thermosetting such as fiber reinforced phenolics, glass fiber reinforced nylon, polyproylene and the like. The choice of the particular materials employed for the brackets will depend upon the desired life span required, expected stresses on the insulatin panels as well as environmental considerations, corrosion and the like.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A counter batten-rafter connecting bracket, the bracket comprising a generally sheet-like body, the sheet-like body having a first planar arm or rafter engaging member to be nailed or otherwise secured to a roof rafter, a generally planar connecting member, having a generally planar configuration extending generally normally to the rafter engaging member, a counter batten engaging member affixed to the connecting member, the counter batten engaging member extending generally parallel to the rafter engaging member; the counter batten engaging member affixed to the connecting member, the counter batten engaging member extending generally normal to a plane containing the connecting member, the counter batten fastening member being generally remote from the rafter engaging member, the counter batten fastening member lying in a plane generally normal to the connecting member, the rafter engaging member and counter batten engaging member each has at least one flange disposed in a plane normal to the planes of the rafter engaging member, counter batten engaging member and connecting member.

2. The bracket of claim 1 wherein the rafter engaging member and the counter batten engaging member each defines two parallel spaced apart flanges extending in planes generally normal to the planes of the rafter engaging member, connecting member and counter batten engaging member.

3. The bracket of claim 1 wherein the connecting member is of a variable length.

4. The bracket of claim 1 wherein the connecting member has a generally Z-shaped configuration and is adapted for use with insulating boards having shiplap joints therebetween.

5. The bracket of claim 1 having a generally Z-shaped configuration.

6. The bracket of claim 1 having a generally U-shaped configuration.

7. The bracket of claim 1 wherein the counter batten engaging member has a counter batten fastening flange extending generally normal to the counter batten fastening member and the connecting member.

8. The bracket of claim 1 wherein the rafter engaging member has at least one rafter engaging flange extending in a plane normal to the plane of the rafter engaging member and the plane of the connecting member.

9. A roof structure comprising a plurality of generally elongate rafters, the rafters being arranged in a generally planar manner, the plane of the rafters being such that a roof pitch is thereby obtained, a layer of generally rigid thermal insulation being disposed above the rafters, a counter batten being disposed over the layer of rigid insulation and being affixed to said rafters, the improvement which comprises affixing the counter batten to the rafters, employing a counter batten-rafter connecting bracket, the bracket comprising a generally sheet-like body, the sheet-like body having a first planar arm or rafter engaging member to be nailed or otherwise secured to a roof rafter, a generally planar connecting member, having a generally planar configuration extending generally normally to the rafter engaging member, a counter batten engaging member affixed to the connecting member, the counter batten engaging member extending generally parallel to the rafter engaging member; the counter batten engaging member affixed to the connecting member, the counter batten engaging member extending generally normal to a plane containing the connecting member, the counter batten engaging member being generally remote from the rafter engaging member, the counter batten engaging member lying in a plane generally normal to the member, the rafter engaging member and counter batten engaging member each has at least one flange disposed in a plane normal to the planes of the rafter engaging member, counter batten engaging member and connecting member.

10. The roof of claim 9 wherein the rafter engaging member and the counter batten engaging member each defines two parallel spaced apart flanges extending in planes generally normal to the planes of the rafter engaging member connecting member and counter batten engaging member.

11. The roof of claim 9 wherein the connecting eember is of a variable length.

12. The roof of claim 9 wherein the connecting member has a generally Z-shaped configuration and is adapted for use with insulating boards having shiplap joints therebetween.

13. The roof of claim 9 wherein the bracket has a generally Z-shaped configuration.

14. The roof of claim 9 wherein the bracket has a generally U-shaped configuration.

15. The roof of claim 9 wherein the counter batten engaging member has a counter batten fastening flange extending generally normal to the counter batten fastening member and the connecting member.

16. The roof of claim 9 wherein the rafter engaging member has at least one rafter engaging flange extending in a plane normal to the plane of the rafter engaging member and the plane of the connecting member.

* * * * *